US006581691B1

(12) United States Patent
Jennings et al.

(10) Patent No.: US 6,581,691 B1
(45) Date of Patent: Jun. 24, 2003

(54) LANDING ADAPTER FOR SOFT LANDING A TUBING HANGER IN THE BORE OF A PRODUCTION TREE OR WELLHEAD HOUSING

(75) Inventors: Charles E. Jennings, Houston, TX (US); Norman Brammer, Aberdeen (GB)

(73) Assignee: ABB Vetco Gray Inc., Houston, TX (US)

( * ) Notice: Subject to any disclaimer, the term of this patent is extended or adjusted under 35 U.S.C. 154(b) by 42 days.

(21) Appl. No.: 09/938,881

(22) Filed: Aug. 27, 2001

Related U.S. Application Data

(60) Provisional application No. 60/232,011, filed on Sep. 12, 2000.

(51) Int. Cl.[7] ..... E21B 33/043

(52) U.S. Cl. ..... 166/348; 166/75.14; 166/88.1; 166/368

(58) Field of Search ..... 166/348, 368, 166/88.1, 75.14

(56) References Cited

U.S. PATENT DOCUMENTS 4,386,656 A * 6/1983 Fisher et al. ..... 166/117.5
5,247,997 A * 9/1993 Puccio ..... 166/348
5,575,336 A * 11/1996 Morgan ..... 166/330
6,082,460 A 7/2000 June ..... 166/348

OTHER PUBLICATIONS

Patent Application Filed Aug. 22, 2001 entitled "Running Tool for Soft Land a Tubing Hanger in a Wellhead Housing".

* cited by examiner

*Primary Examiner*—Hoang Dang
(74) *Attorney, Agent, or Firm*—Bracewell & Patterson, L.L.P.

(57) ABSTRACT

A landing adapter is used to softly land a tubing hanger in the bore of a production tree. The landing adapter makes initial contact so that the tubing hanger does not have to absorb the harsh impact. The landing adapter has a hydraulic sleeve that strokes axially relative to the tubing hanger. Initially, the sleeve is extended and locked when it is run into the well so that the landing adapter can be hard-landed in the bore. When the sleeve lands in the bore, the impact is absorbed by a landing adapter buffer, not by the tubing hanger. After the hanger with the landing adapter has landed in the bore, hydraulic fluid is bled off so that the tubing hanger gradually descends axially relative to the sleeve and the tree to the retracted position. The landing adapter buffer remains in the tree after the tubing hanger is landed in the bore.

12 Claims, 4 Drawing Sheets

LANDING ADAPTER FOR SOFT LANDING A TUBING HANGER IN THE BORE OF A PRODUCTION TREE OR WELLHEAD HOUSING

This patent application is based upon U.S. provisional patent application Ser. No. 60/232,011, filed Sep. 12, 2000.

TECHNICAL FIELD

This invention relates in general to an improved tubing hanger, and in particular to an improved landing adapter for providing a soft landing for a tubing hanger in the bore of a tree or wellhead housing.

DESCRIPTION OF THE PRIOR ART

Designs for landing tubing hangers in casing hangers for wells in the ocean floor are well known in the prior art. A tubing hanger typically carries or suspends one or more strings of tubing which extend down into the subsea well. Many different tubing hanger designs exist and are the subject of numerous prior art patents. Some of the earlier versions of tubing hangers required a running tool employing a dart for operation that restricted the bore of the tubing hanger. Other designs provide a running tool allowing full bore tubing access during running, while providing means for controlling downhole safety valves during both running and landing operations.

For example, in U.S. Pat. No. 4,067,062, the tubing hanger is lowered into the well and releasably secured to the casing hanger by hydraulic manipulation of the running tool after the tubing hanger has been oriented in the casing hanger. After further hydraulic manipulation, the running tool may be released from the hydraulic set tubing hanger and later run back into the well and reconnected to the tubing hanger for retrieval. Although each of these designs are workable, it is difficult to avoid "hard" landing and possibly damaging the tubing hanger in the well due to the depths at which the subsea wells are typically located. Thus, an improved design for "soft" landing a tubing hanger in a wellhead is needed.

SUMMARY OF THE INVENTION

In one embodiment of the present invention, a tubing hanger with a landing adapter is installed in the bore of a production tree. The landing adapter is permanently mounted on the lower end of the tubing hanger to softly land the tubing hanger. The landing adapter acts as a buffer between the conventional landing shoulder in the bore and a shoulder on the tubing hanger. The landing adapter makes the initial contact with the bore so that the tubing hanger does not have to absorb the harsh impact.

The landing adapter comprises a hydraulically-actuated sleeve that strokes axially relative to the tubing hanger. Initially, the sleeve is extended and locked when it is run into the well so that the landing adapter can be hard-landed in the bore. When the sleeve lands in the bore, the impact is absorbed by the landing adapter buffer, not by the tubing hanger. After the hanger with the landing adapter has landed in the bore, hydraulic fluid is bled off so that the tubing hanger gradually descends axially relative to the sleeve and the tree to the retracted position. The landing adapter buffer remains in the tree and is not retrieved after the tubing hanger is landed in the bore.

BRIEF DESCRIPTION OF DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT OF THE INVENTION

Figure 1:
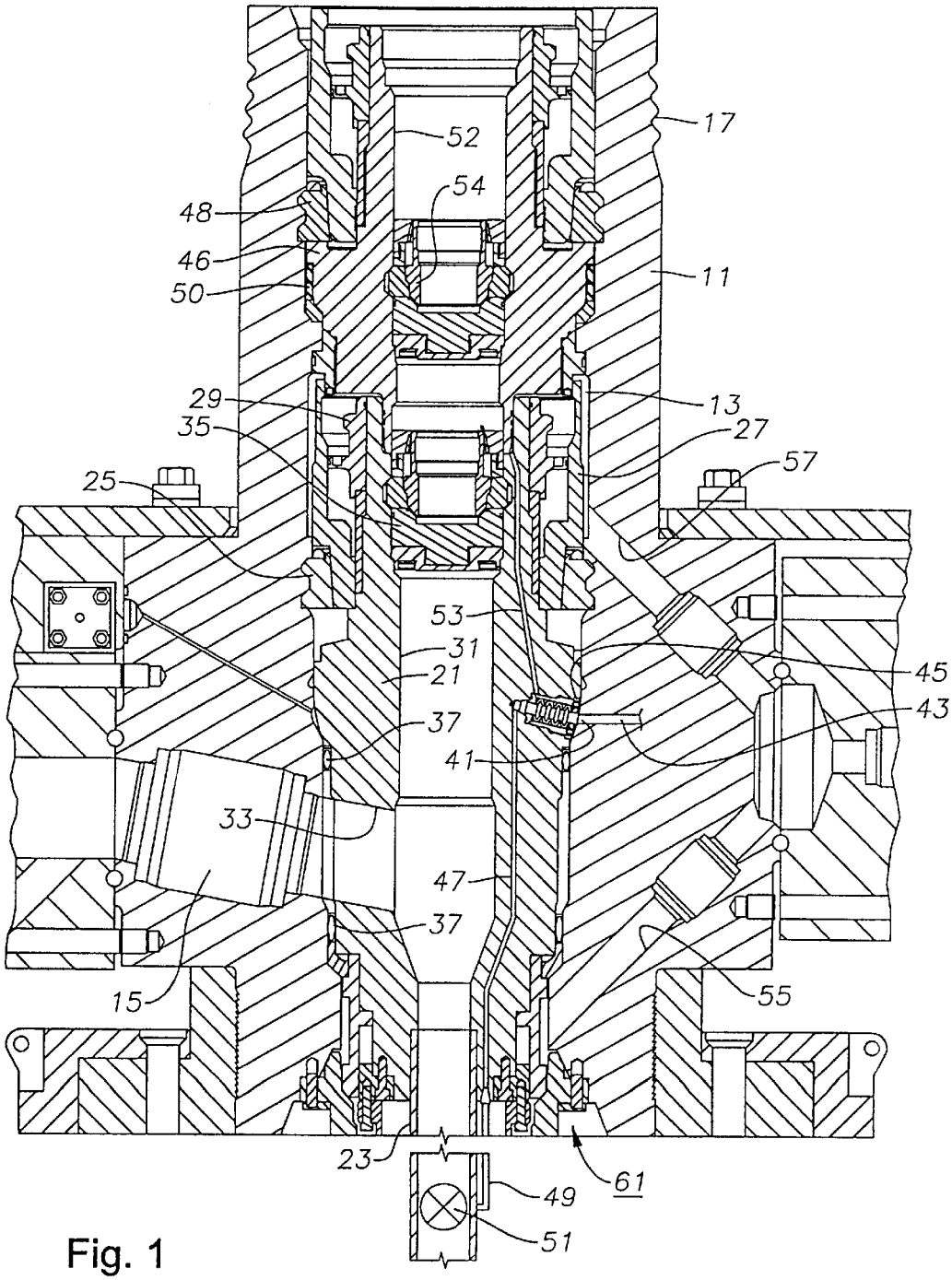
FIG. 1 is a sectional side view of a horizontal tree having a tubing hanger constructed in accordance with a first embodiment of the invention, with the tubing hanger shown landed in the horizontal tree.

Referring to FIG. 1, a production tree 11 is of a type known as a "horizontal tree. " Although production tree 11 is depicted as a horizontal tree, it could also be a conventional tree (not shown), wherein the tubing hanger would go in the wellhead below the tree. Production tree 11 lands on a wellhead housing, typically located on the sea floor. Production tree 11 has a vertical bore 13 extending through it. A lateral passage 15 extends from bore 13 for the flow of production fluid. Production tree 11 has a groove profile 17 on its exterior upper end for connection to a rise (not shown) while lowering the tree 11 to the sea floor and during completion operations. After installation is complete, a cover (not shown) will be placed over the upper end of production tree 11.

A tubing hanger 21 lands in bore 13 of production tree 11. Tubing hanger 21 supports a string of tubing 23 that extends into the well for the flow of production fluid. Tubing hanger 21 is secured in bore 13 by a plurality of dog segments 25. A cam or lower sleeve 27, when moved axially downward, pushes dog segments 25 outward into a profile in bore 13. A collar 29 on the upper end of tubing hanger 21 is used for engaging tubing hanger 21 while lowering it into tree 11.

Tubing hanger 21 has an axial passage 31 and a lateral passage 33 extending therefrom that is rotationally oriented and axially aligned with production tree lateral passage 15. A wireline plug 35 is installed in axial passage 31 above lateral passage 33 to cause production fluid flow to flow out lateral passage 33. Circumferential seals 37 locate above and below lateral passage 33.

Tubing hanger 21 also has a number of auxiliary ports 41 (only one shown) that are spaced circumferentially around it. Each port 41 aligns with a tree auxiliary passage 43 (only one shown) for communicating hydraulic fluid or other fluids for various purposes to tubing hanger 21, and from tubing hanger 21 downhole. In FIG. 1, tree auxiliary passage 43 communicates hydraulic fluid pressure to auxiliary port 41. Tubing hanger 21 has an annular partially spherical exterior portion that lands within a partially spherical surface 45 formed in bore 13. Tree auxiliary passage 43 terminates in spherical surface 45.

Auxiliary port 41 leads to a lower auxiliary passage 47 that extends to the lower end of tubing hanger 21. Lower auxiliary passage 47 connects to a hydraulic line 49 that extends alongside tubing 23 to a downhole safety valve 51. Downhole safety valve 51 allows the flow of production fluid through tubing 23 while hydraulic fluid pressure is supplied to it, and blocks flow in the absence of hydraulic fluid pressure. Tubing hanger 21 also has an upper auxiliary passage 53 extending from auxiliary port 41 to the upper end of tubing hanger 21.

A tubing annulus surrounds tubing 23 within the casing of the well. The tubing annulus communicates with a lower annulus passage 55 extending through tree 11. Lower annulus passage 55 leads to a pair of valves, which in turn connect to an upper annulus passage 57. Lower annulus passage 55 enters bore 13 below the lower of the two tubing hanger seals 37. Upper annulus passage 57 enters bore 13 above the upper of the two tubing hanger seals 37. Passages 55, 57 thus bypass the seals 37 of tubing hanger 21. Upper annulus passage 57 communicates with the space between collar 29 and running tool 61.

After installation of tubing hanger 21, an internal tree cap 46 lands in bore 13 above tubing hanger 21. Locking device 48 secures internal tree cap 46 in place. Seals 50 seal internal tree cap 46 to bore 13. Internal tree cap 46 has an axial bore 52 that registers with the axial bore 31 of tubing hanger 21. A wireline plug 54 is installed in bore 31 above wireline plug 35.

Figure 3:
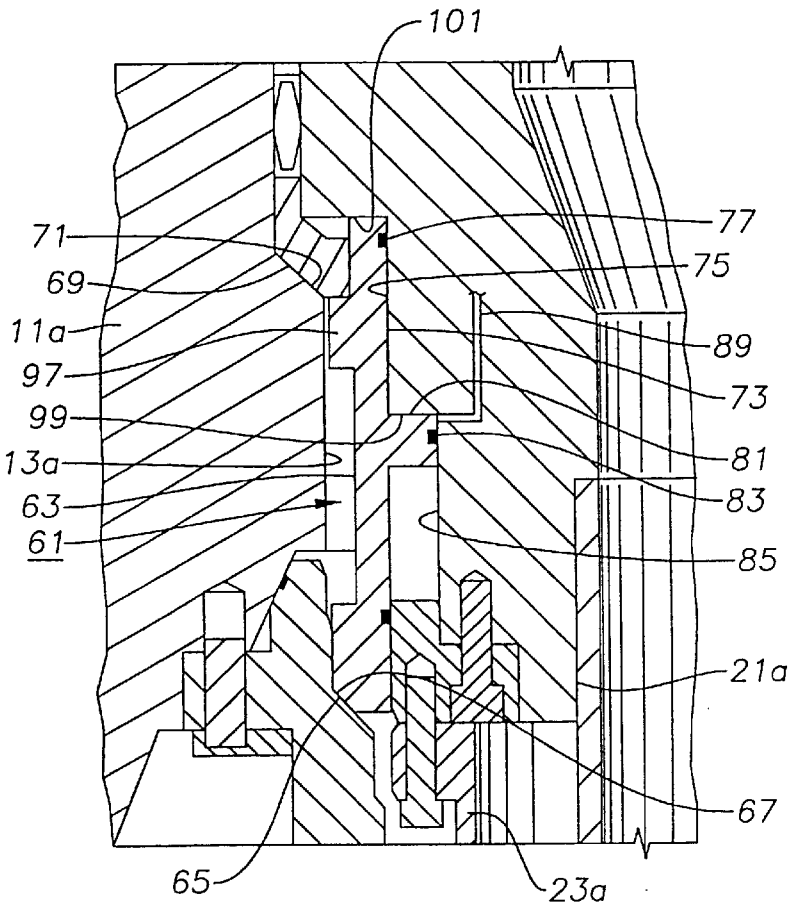
FIG. 3 is an enlarged sectional side view of the left half of the lower end of the horizontal tree and tubing hanger of FIG. 1, with the tubing hanger shown after landing.
Figure 2:
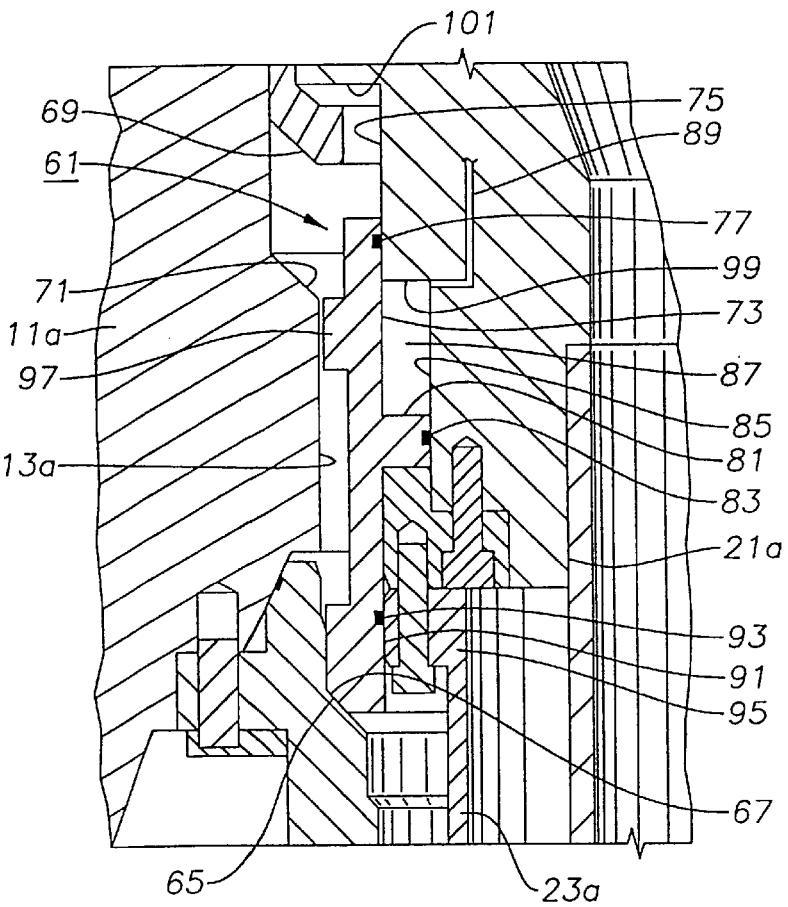
FIG. 2 is an enlarged sectional side view of the left half of a lower end of the horizontal tree and tubing hanger of FIG. 1, with the tubing hanger shown prior to landing.

Referring now to FIGS. 2 and 3, a tubing hanger 21*a* is installed in bore 13*a* of a production tree 11*a* with a landing buffer or adapter 61 constructed in accordance with a first embodiment of the present invention. Landing adapter 61 is located on the lower end of tubing hanger 21*a* to softly or gradually land tubing hanger 21*a* and a conventional horizontal tree spool 23*a*. Tubing (not shown) is screwed into a tapered hole in the center of tubing hanger 21, at the surface before the tubing and hanger are run in the well, taking place after tree 11*a* has been installed. Note that tubing hanger 21 is run into tree 11 by conventional, unmodified tubing hanger running tools. Landing adapter 61 of the present invention is a sleeve or buffer manufactured onto the bottom of tubing hanger 21. Landing adapter 61 acts as a buffer between the conventional landing shoulder 71 and tubing hanger shoulder 69. Landing adapter 61 makes the initial contact with bore 13*a* so that tubing hanger 21*a* does not have to absorb the harsh impact.

Landing adapter 61 comprises a generally cylindrical sleeve 63 (FIG. 3) that circumscribes tubing hanger 21*a*. Sleeve 63 strokes axially relative to tubing hanger 21*a* between an extended position (FIG. 2) and a retracted position (FIG. 3). Sleeve 63 has a tapered lower shoulder 65 that lands on a tapered inner shoulder 67 in the spool bore below tubing hanger 21*a*. Lower shoulders 65 and 67 make contact before an upper shoulder 69 on tubing hanger 21*a* lands on a shoulder 71 in bore 13*a*. The upper inner surface 73 of sleeve 63 slidingly receives outer surface 75 on tubing hanger 21*a*. Surface 73 is sealed to surface 75 with seal 77. An inner, annular flange 81 protrudes radially inward from the midsection of sleeve 63. Flange 81 has a smooth inner surface with a seal 83 that seals and slides against an outer surface 85 of tubing hanger 21*a*.

A sealed chamber 87 (FIG. 2) having a fluid passage 89 is located between seals 77, 83. Passage 89 communicates hydraulic fluid to and from chamber 87. The lower inner surface 91 of sleeve 63 is provided with a seal 93 for slidingly receiving elements 95 on the outer surface of the lower end of tubing hanger 21*a*. Sleeve 63 also has outer, annular flange 97 that protrudes radially outward from a location near the upper end of sleeve 63. Flange 97 engages the inner surface of bore 13*a*.

In operation, the operator connects hydraulic fluid sources to tubing hanger 21*a* for passage 89 and chamber 87 in landing adapter 61. At this stage, sleeve 63 is in the extended position (FIG. 2). Pressure applied through passage 89 to chamber 87 strokes sleeve 63 down to the extended position. The operator runs the assembly into the well. When tubing hanger 21*a* enters bore 13*a*, it will be rotationally oriented by an orienting device to align horizontal passage 33 (FIG. 1) with horizontal passage 15. As shown in FIG. 2, chamber 87 is initially locked so that landing adapter 61 can be hard-landed in bore 13*a*. When the outer shoulder 65 on sleeve 63 lands on inner shoulder 67 in bore 13*a*, the impact is absorbed by landing adapter buffer 61, not by tubing hanger 21*a*. At this point, the lower surface of flange 81 abuts the upper surface of element 95.

After landing adapter 61 has landed in bore 13*a*, the hydraulic fluid in chamber 87 is bled off so that tubing hanger 21*a* descends axially relative to sleeve 63 and tree 11*a* to the retracted position (FIG. 3). This process is gradual so that tubing hanger 21*a* is landed "softly" on spherical surface 45 (FIG. 1). As shown in FIG. 3, the upper surface of flange 81 abuts a lower shoulder 99 on tubing hanger 21*a*, and the uppermost surface of sleeve 63 abuts a lower shoulder 101 on tubing hanger 21*a*. In addition, the upper surface of flange 97 abuts the lower end of shoulder 71 on tubing hanger 21*a*. Landing adapter buffer 61 remains in tree 11*a* after tubing hanger 21*a* is landed in bore 13*a*.

Figure 5:
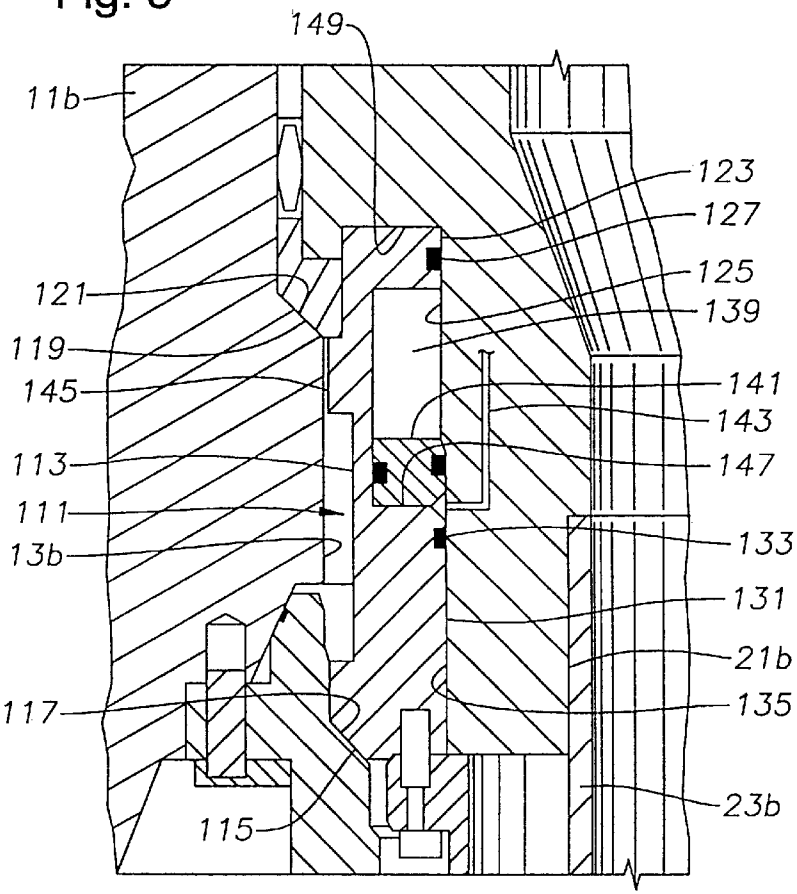
FIG. 5 is an enlarged sectional side view of the left half of the lower end of the horizontal tree and tubing hanger of FIG. 4, with the tubing hanger shown after landing.
Figure 4:
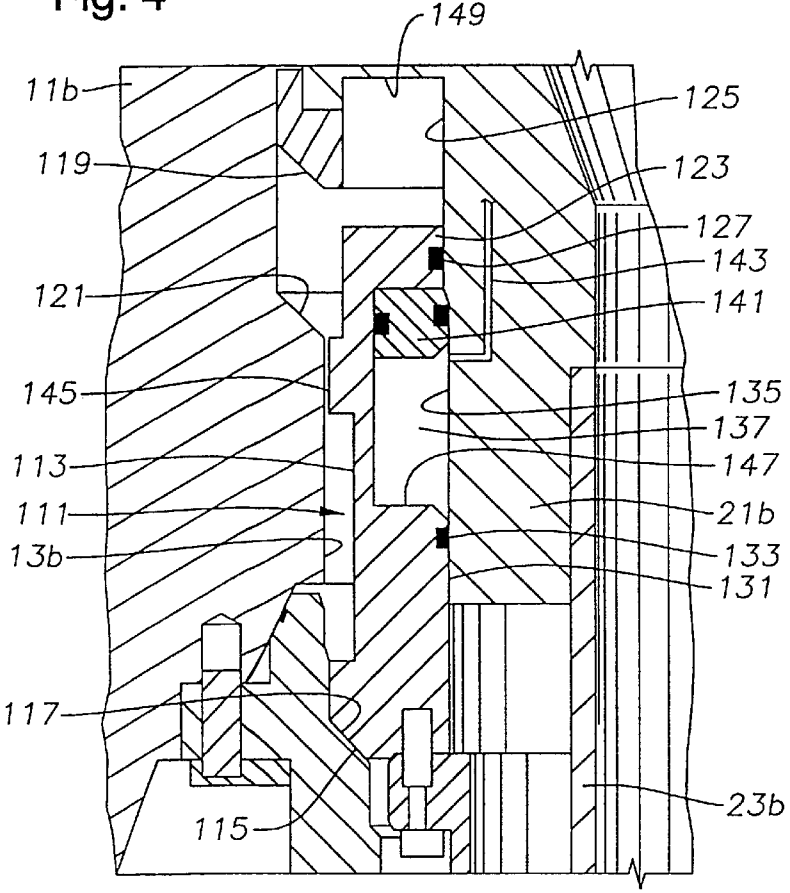
FIG. 4 is an enlarged sectional side view of the left half of a lower end of a horizontal tree and a second embodiment of a tubing hanger constructed in accordance with the invention, with the tubing hanger shown prior to landing.

Referring now to FIGS. 4 and 5, a second embodiment of a landing adapter buffer 111 constructed in accordance with the present invention also may be used to install tubing hanger 21*b* in production tree 11*b*. Like landing adapter buffer 61, landing adapter 111 is also manufactured as part of tubing hanger 21, and is located on the lower end of tubing hanger 21*b* to softly land tubing hanger 21*b* in the well. Landing adapter 111 makes initial contact with bore 13*b* so that tubing hanger 21*b* does not have to absorb the impact.

Landing adapter 111 comprises a sleeve 113 that strokes axially relative to tubing hanger 21*b* between an extended position (FIG. 4) and a retracted position (FIG. 5). Sleeve 113 has a lower shoulder 115 that lands on an inner shoulder 117 in a spool in bore 13*b* below tubing hanger 21*b*. The inner surface of a flange 123 on sleeve 113, having a seal 127, slidingly receives outer surface 125 on tubing hanger 21*b*. Sleeve 113 also has a smooth inner surface 131 with a seal 133 for engaging outer surface 135 of tubing hanger 21*b*. Sealed chambers 137 (FIG. 4) and 139 (FIG. 5) are located below and above, respectively, of a ring 141 that is rigidly mounted on the exterior of tubing hanger 21*b*. A hydraulic fluid passage 143 communicates with chamber 137. Sleeve 113 also has outer, annular flange 145 near the upper end of sleeve 113 for engaging bore 13*b*.

In operation, the operator and connects hydraulic fluid sources to tubing hanger 21*b* and applies pressure through passage 143 to chamber 137 to stroke sleeve 113 down to the extended position. As shown in FIG. 4, chamber 137 is initially locked so that landing adapter 111 can be hard-landed in bore 13*b*. When the outer shoulder 115 on sleeve 113 lands on inner shoulder 117, the impact is absorbed by landing adapter 111, not by tubing hanger 21*b*. At this point, the lower surface of flange 123 abuts the upper surface of ring 141.

After landing adapter 111 has landed on shoulder 117, the hydraulic fluid in chamber 137 is bled off so that tubing hanger 21*b* descends axially relative to sleeve 113 and tree 11*b* to the retracted position (FIG. 5). This process is gradual so that tubing hanger 21*b* is landed "softly. " As shown in FIG. 5, an upper surface 147 above seal 133 abuts the lower surface of ring 141, and the uppermost surface of sleeve 113 abuts a lower shoulder 149 on tubing hanger 21*b*. Landing adapter 111 remains in tree 11*b* after tubing hanger 21*b* is landed in bore 13*b*.

Figure 7:
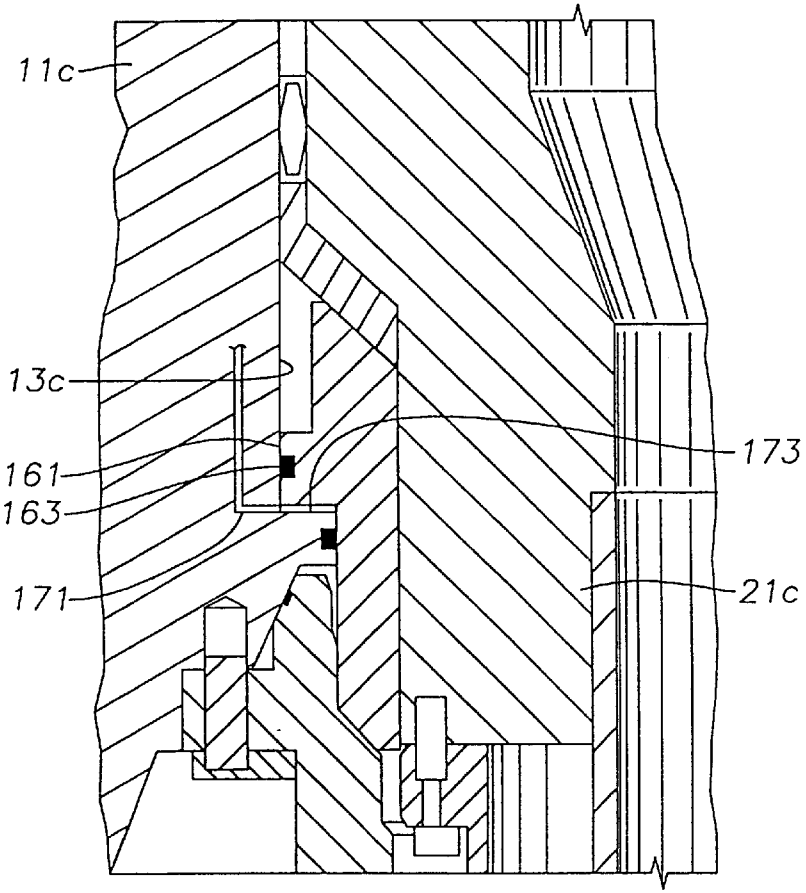
FIG. 7 is an enlarged sectional side view of the left half of the lower end of the horizontal tree and tubing hanger of FIG. 6, with the tubing hanger shown after landing.
Figure 6:
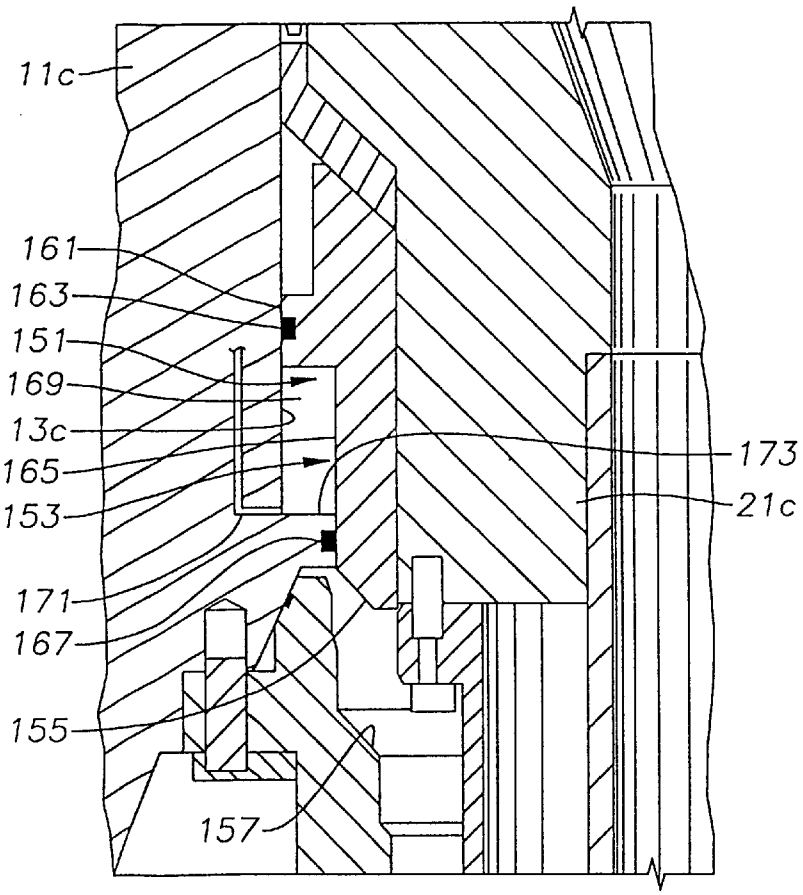
FIG. 6 is an enlarged sectional side view of the left half of a lower end of a horizontal tree and a third embodiment of a tubing hanger constructed in accordance with the invention, with the tubing hanger shown prior to landing.

Referring now to FIGS. 6 and 7, a third embodiment of a landing adapter buffer 151 constructed in accordance with the present invention also may be used to install tubing hanger 21*c* in production tree 11*c*. In this case, landing adapter 151 is manufactured into tree 11*c* to make initial contact with tubing hanger 21*c* so that tubing hanger 21*c* does not have to absorb the impact. Landing adapter 151 has a sleeve 153 that is mounted to the interior of bore 13*c*. Sleeve 153 has a lower shoulder 155 that lands on an inner shoulder 157 in the spool within bore 13*c*. Shoulder 155 is suspended above shoulder 157 by the presence of pressurized fluid in chamber 169. The outer surface of an external flange 161 on sleeve 153, having a seal 163, slidingly receives bore 13*c*. Sleeve 153 also has a smooth, outer lower surface 165 for engaging a seal 167 in bore 13*c*. A sealed chamber 169 (FIG. 6) is located between seals 163, 167. A hydraulic fluid passage 171 extends through tree 11*c* to communicate with chamber 169.

In operation, the operator connects hydraulic fluid sources to tree 11*c* and lowers the tubing hanger 21*c* into bore 13*c*. Tubing hanger 21*c* is landed on top of landing adapter 151 which is already fixed in the extended position in bore 13*c* of tree 11*c*. When tubing hanger 21*c* contacts landing adapter 151, pressure in chamber 169 is bled off between seals 163, 167 (FIG. 6). As tubing hanger 21*c* continues downward into tree 11*c*, shoulder 155 lands on inner shoulder 157 (FIG. 7). At this point, the lower surface of flange 161 also abuts a flat shoulder 173 in bore 13*c*. Landing adapter 151 remains in tree 11*c* after tubing hanger 21*c* is landed in bore 13*c*.

The invention has the advantage of absorbing the hard impact of a landing in a wellhead with the landing adapter, rather than with the tubing hanger. After the landing adapter has been landed in the wellhead, the tubing hanger is gently or softly landed within the production tree via a hydraulic mechanism which slowly bleeds off hydraulic fluid.

While the invention has been shown or described in only some of its forms, it should be apparent to those skilled in the art that it is not so limited, but is susceptible to various changes without departing from the scope of the invention.

What is claimed is:

1. A wellhead assembly, comprising:

a wellhead member having a bore and a landing shoulder located therein;

a tubing hanger adapted to be connected to a string of tubing;

a landing adapter mounted to the tubing hanger for axial movement relative to the tubing hanger from an extended position, while running the tubing hanger into the wellhead member, to a retracted position, the landing adapter having a shoulder that lands on the landing shoulder in the bore, the shoulder having an outer diameter that is at least equal to the outer diameter of all other portions of the landing adapter, the landing adapter having an inner portion that sealingly and slidingly engages the tubing hanger, defining a fluid chamber; and a relief passage for the fluid chamber, that relieves fluid pressure in the fluid chamber after the shoulder of the landing adapter lands on the landing shoulder, causing the tubing hanger to move downward relative to the landing adapter until the landing adapter reaches the retracted position.

2. The wellhead assembly according to claim 1, wherein the inner portion of the landing adapter has an upper portion located at an upper end of the landing adapter.

3. The wellhead assembly according to claim 1, further comprising a seal located on the inner portion of the landing adapter for sealingly engaging the tubing hanger, the seal being located adjacent an upper end of the inner portion.

4. The wellhead assembly according to claim 1, wherein:

the tubing hanger has an upper cylindrical surface and a lower cylindrical surface separated by a downward facing surface that is stationary relative to the tubing hanger; and the inner portion of the landing adapter engages the upper and lower cylindrical surfaces and has an upward facing portion that contacts the downward facing surface while in the retracted position.

5. The wellhead assembly according to claim 1, wherein:

the tubing hanger has a cylindrical surface;

the tubing hanger has a ring stationarily mounted thereto at an upper end of the cylindrical surface;

the inner portion of the landing adapter comprises a first portion that sealingly engages the cylindrical surface of the tubing hanger and a second portion that sealingly engages an outer diameter of the ring; and the landing adapter has a portion that contacts a lower side of the ring while in the retracted position.

6. The wellhead assembly according to claim 5, further comprising a seal on an inner diameter of the ring that seals the ring to the tubing hanger.

7. A wellhead assembly, comprising:

a tubing hanger adapted to be connected to a string of tubing, the tubing hanger having an upper cylindrical surface and a lower cylindrical surface of lesser diameter than the upper cylindrical surface, defining a downward facing surface at a junction of the cylindrical surfaces that is stationary relative to the tubing hanger;

a landing adapter mounted to the tubing hanger for axial movement relative to the tubing hanger from an extended position, while running the tubing hanger into the wellhead member, to a retracted position, the landing adapter having a shoulder adapted to land on a landing shoulder in a bore of a wellhead member;

the landing adapter having a first inner portion that sealingly and slidingly engages the upper cylindrical surface of the tubing hanger;

the landing adapter having a second inner portion that sealingly and slidingly engages the lower cylindrical surface of the tubing hanger, defining a fluid chamber;

the landing adapter having an upward facing portion that contacts the downward facing surface while in the retracted position; and a relief passage for the fluid chamber for relieving fluid pressure in the fluid chamber after the landing adapter lands on the landing shoulder in the bore, allowing the tubing hanger to move downward relative to the landing adapter until the landing adapter reaches the retracted position.

8. The wellhead assembly according to claim 7, wherein the first inner portion is located at an upper end of the landing adapter.

9. The wellhead assembly according to claim 7, wherein the landing adapter has a maximum outer diameter, and wherein the shoulder has a diameter that is not less than the maximum outer diameter.

10. A wellhead assembly, comprising:

a wellhead member having a bore;

a landing adapter mounted in the bore of the wellhead member for axial movement relative to the wellhead member between upper and lower positions, the landing adapter having a landing shoulder;

the landing adapter having an exterior portion that sealing engages the bore of the wellhead member, defining a fluid chamber between the landing adapter and the bore;

a tubing hanger adapted to be connected to a string of tubing and having a shoulder that lands on the landing shoulder of the landing adapter while the landing adapter is in the upper position; and a relief passage in the wellhead member leading to the fluid chamber for relieving fluid pressure in the fluid chamber after the tubing hanger lands on the landing adapter, causing the landing adapter and the tubing hanger to move downward until the landing adapter reaches the lower position.

11. The wellhead assembly according to claim 10, wherein the relief passage supplies hydraulic fluid pressure to maintain the landing adapter in the upper position prior to the shoulder of the tubing hanger landing on the landing shoulder of the landing adapter.

12. The wellhead assembly according to claim 10, wherein the bore has an upper cylindrical portion and a lower cylindrical portion of lesser inner diameter than the upper cylindrical portion, and wherein the landing adapter sealingly engages the upper and lower cylindrical portions to define the fluid chamber.

* * * * *

UNITED STATES PATENT AND TRADEMARK OFFICE

CERTIFICATE OF CORRECTION

PATENT NO. : 6,581,691 B1 
DATED : June 24, 2003
INVENTOR(S) : Charles E. Jennings et al.

It is certified that error appears in the above-identified patent and that said Letters Patent is hereby corrected as shown below:

Column 2,
Line 48, delete “rise” and insert therefore -- riser --.

Column 5,
Line 1, after “operator” delete “and”.

Signed and Sealed this

Eighteenth Day of November, 2003

JAMES E. ROGAN
*Director of the United States Patent and Trademark Office*